US008024161B2

(12) United States Patent
Pekar et al.

(10) Patent No.: US 8,024,161 B2
(45) Date of Patent: Sep. 20, 2011

(54) METHOD AND SYSTEM FOR MODEL-BASED MULTIVARIABLE BALANCING FOR DISTRIBUTED HYDRONIC NETWORKS

(75) Inventors: Jaroslav Pekar, Pacov (CS); Vladimir Havlena, Prague (CS); Werner Hugger, Heilbronn (DE)

(73) Assignee: Honeywell International Inc., Morristown, NJ (US)

( * ) Notice: Subject to any disclaimer, the term of this patent is extended or adjusted under 35 U.S.C. 154(b) by 532 days.

(21) Appl. No.: 12/193,955

(22) Filed: Aug. 19, 2008

(65) Prior Publication Data

US 2010/0049480 A1 Feb. 25, 2010

(51) Int. Cl.

| | |
|---|---|
| ***G06F 7/60*** | (2006.01) |
| ***G06F 7/50*** | (2006.01) |
| ***G05D 7/00*** | (2006.01) |
| ***G05D 9/00*** | (2006.01) |

(52) U.S. Cl. ..... 703/2; 703/9; 700/282; 700/281

(58) Field of Classification Search ..... 137/12; 703/2; 700/282, 281

See application file for complete search history.

(56) References Cited

U.S. PATENT DOCUMENTS

| | | | | |
|---|---|---|---|---|
| 4,478,783 | A * | 10/1984 | Broadwater | 700/282 |
| 5,315,530 | A * | 5/1994 | Gerhardt et al. | 700/282 |
| 5,472,014 | A * | 12/1995 | Carlson | 137/556 |
| 5,642,278 | A * | 6/1997 | Wang et al. | 700/29 |
| 6,021,677 | A * | 2/2000 | Hepner | 73/861.42 |
| 6,611,736 | B1 * | 8/2003 | Waite et al. | 703/2 |
| 6,829,522 | B1 * | 12/2004 | Filev et al. | 700/282 |
| 6,983,764 | B2 | 1/2006 | Arrowood, Jr. et al. | 137/636.1 |
| 6,991,028 | B2 | 1/2006 | Comeaux et al. | 165/219 |
| 7,194,318 | B2 * | 3/2007 | Attarwala | 703/2 |
| 7,284,709 | B2 | 10/2007 | Guyer | 237/12.1 |
| 7,353,843 | B2 | 4/2008 | Arrowood, Jr. et al. | 137/595 |
| 7,392,113 | B2 * | 6/2008 | Dykstra | 700/282 |
| 7,610,183 | B2 * | 10/2009 | Danko | 703/2 |

(Continued)

FOREIGN PATENT DOCUMENTS

FR 2903763 A1 1/2008

(Continued)

OTHER PUBLICATIONS

J Pekar et al, "Matlab As a Prototyping Tool for Hydronic Networks Balancing" Honeywell Prague Laboratory, pp. 1-5, Oct. 21, 2008.*

(Continued)

*Primary Examiner* — Kamini S Shah
*Assistant Examiner* — Akash Saxena
(74) *Attorney, Agent, or Firm* — Gregory M. Ansems; Luis M. Ortiz; Kermit D. Lopez

(57) ABSTRACT

A method and system for optimal model-based multivariable balancing for distributed hydronic networks based on global differential pressure/flow rate information. A simplified mathematical model of a hydronic system can be determined utilizing an analogy between hydronic systems and electrical circuits. Thereafter, unknown parameters can be identified utilizing the simplified mathematical model and a set of available measurements. Next, balancing valve settings can be calculated by reformulating the simplified mathematical model based on the parameterized model. The sum of pressure drops across selected balancing valves can be then minimized to achieve optimal economic performances of the system. The data can be collected and transferred to a central unit either by wireless communication or manually by reading the local measurement devices. Such a multivariable balancing approach provides a fast and accurate balancing of distributed hydronic heating systems based on a centralized and non-iterative approach.

15 Claims, 5 Drawing Sheets

U.S. PATENT DOCUMENTS

| | | | | |
|---|---|---|---|---|
| 7,857,233 | B2 * | 12/2010 | Trantham | 700/282 |
| 2005/0049838 | A1 * | 3/2005 | Danko | 703/2 |
| 2007/0255536 | A1 * | 11/2007 | Simmons et al. | 703/1 |
| 2008/0165613 | A1 * | 7/2008 | Dykstra | 700/281 |
| 2009/0076779 | A1 * | 3/2009 | Simmons et al. | 703/1 |
| 2009/0271154 | A1 * | 10/2009 | Coad et al. | 703/1 |
| 2010/0094603 | A1 * | 4/2010 | Danko | 703/2 |
| 2010/0147394 | A1 * | 6/2010 | Trnka et al. | 137/12 |
| 2011/0077781 | A1 * | 3/2011 | Milder et al. | 700/282 |

FOREIGN PATENT DOCUMENTS

| | | | |
|---|---|---|---|
| JP | 63271573 | A * | 11/1988 |

OTHER PUBLICATIONS

N. Couillaud, P. Riederer, M. Jandon, Y. Diab; Balancing Operation for the Optimisation of Hydronic Networks; ESL-IC-10/05-23.

* cited by examiner

600

| | # of Balancing Valves | # of Independent Equations | # of Unknown Parameters | # of Flow Rates |
|---|---|---|---|---|
| Branch with $n_T$ terminal units | $n_T + 1$ | $n_T$ | $2n_T - 1$ | $n_T$ |
| Riser with $n_B$ branches | $n_B(n_T + 1) + 1$ | $n_B n_T$ | $2n_B n_T - 1$ | $n_B n_T$ |
| Circuit with $n_R$ risers | $n_R(n_B(n_T + 1) + 1) + 1$ | $n_R n_B n_T$ | $2n_R n_B n_T - 1$ | $n_R n_B n_T$ |

FIG. 6

METHOD AND SYSTEM FOR MODEL-BASED MULTIVARIABLE BALANCING FOR DISTRIBUTED HYDRONIC NETWORKS

TECHNICAL FIELD

Embodiments are generally related to hydronic heating and cooling systems. Embodiments also relate in general to the field of computers and similar technologies and in particular to software utilized in this field. In addition, embodiments relate to methods for balancing distributed hydronic networks.

BACKGROUND OF THE INVENTION

The circulation of hot or chilled water to provide heat or cool spaces is known as a hydronic system. A hydronic system is composed of many subsystems such as, for example, boilers, chimney, vertical supply and return piping, horizontal supply and return piping, pump, and convectors, and so forth. Such hydronic heating and cooling systems are based on distributed hydronic networks. In a complex hydronic system such as, for example, a building heating system, hot water is pumped from a central boiler up a common riser from which it flows through a multiplicity of branch lines each including one or more terminals. Then, the multiple streams are reunited in a common downpipe that leads back to the boiler. In such a system it is necessary to balance the flow in the individual branches to achieve the desired technical and economic performance of the system. Thus, each branch can be provided with a balancing valve, which can be provided in the form of a lockable flow-control valve that can be adjusted until a predetermined flow, normally measured in gallons per minute, is obtained in the branch.

A hydronic network represents a complex system that requires the ability to simultaneously correctly solve design, sizing and control-related issues. A design error in one part of the hydronic network affects the rest of the network. Moreover, to correct poor operations associated with unbalanced networks, (e.g., hydronic networks without balancing) building operators typically increase the head of pumps and/or hot water supply temperatures to ensure comfort in all zones of the building. Such an approach results in increased energy consumption with respect to the pumps and probable growth of primary energy to produce hot water, overheating of hydraulically favored zones, and in some cases instability of control loops. Such manual balancing is time consuming and requires a number of iterations.

The majorities of prior art methods for balancing distributed hydronic networks are based on iterative approaches and are decentralized in nature. Such a decentralized approach may control each balancing valve independently via the use of a local control algorithm without any communication between individual balancing valves. Consequently, special equipment must be installed on each of the balancing valves, which decreases the economic performance of the overall system. Additionally, such prior art methods require a number of iterations for the calculation of settings of balancing valves, which is a time-consuming process.

Based on the foregoing it is believed that a need exists for an improved method and system for model-based multivariable balancing with respect to distributed hydronic networks as described in greater detail herein.

BRIEF SUMMARY

The following summary is provided to facilitate an understanding of some of the innovative features unique to the present invention and is not intended to be a full description. A full appreciation of the various aspects of the embodiments disclosed herein can be gained by taking the entire specification, claims, drawings, and abstract as a whole.

It is, therefore, one aspect of the present invention to provide for an improved method and system for balancing hydronic networks.

It is another aspect of the present invention to provide for an improved method for model-based multivariable balancing with respect to distributed hydronic networks.

It is a further aspect of the present invention to provide for an improved method for optimal model-based multivariable balancing for hydronic networks.

It is a further aspect of the present invention to provide for an improved method for balancing hydronic networks based on centralized and non-iterative approaches.

The aforementioned aspects and other objectives and advantages can now be achieved as described herein. A system and method for model-based multivariable balancing for distributed hydronic networks based on global differential pressure/flow rate information is disclosed. A simplified mathematical model of a hydronic system can be determined utilizing an analogy between hydronic systems and electrical circuits. Thereafter, unknown parameters can be identified utilizing such a simplified mathematical model and a set of available measurements. Next, balancing valve settings can be calculated by reformulating the simplified mathematical model based on the parameterized model and the sum of pressure drops across selected balancing valves can be minimized. The data can be collected to a central unit either by wireless communications or manually by reading the local measurement devices. Such a multivariable balancing approach provides a fast and accurate balancing for distributed hydronic heating systems, based on a centralized and non-iterative approach.

The multivariable-balancing algorithm described herein can be formulated as an optimization problem wherein the subject of optimization involves minimizing the sum of pressure drops across selected balancing valves. Additional constraints to the optimization problem can be included and the resulting optimization problem solved by standard mathematical programming algorithms. The multivariable balancing approach is non-iterative and calculates optimal setting for all balancing valves simultaneously and without iterations based on available data. The disclosed approach follows a systematic process that provides an accurate description of the hydronic system. Such an approach can be implemented as a computer program with possible interface to hydronic network actuators and sensors, which can support application engineers in the field in order to reduce the effort and time required for hydronic heating balancing.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 6 illustrates an exemplary table of available measurements associated with the hydronic system, in accordance with a preferred embodiment.

DETAILED DESCRIPTION

The particular values and configurations discussed in these non-limiting examples can be varied and are cited merely to illustrate at least one embodiment and are not intended to limit the scope of such embodiments.

Figure 1:
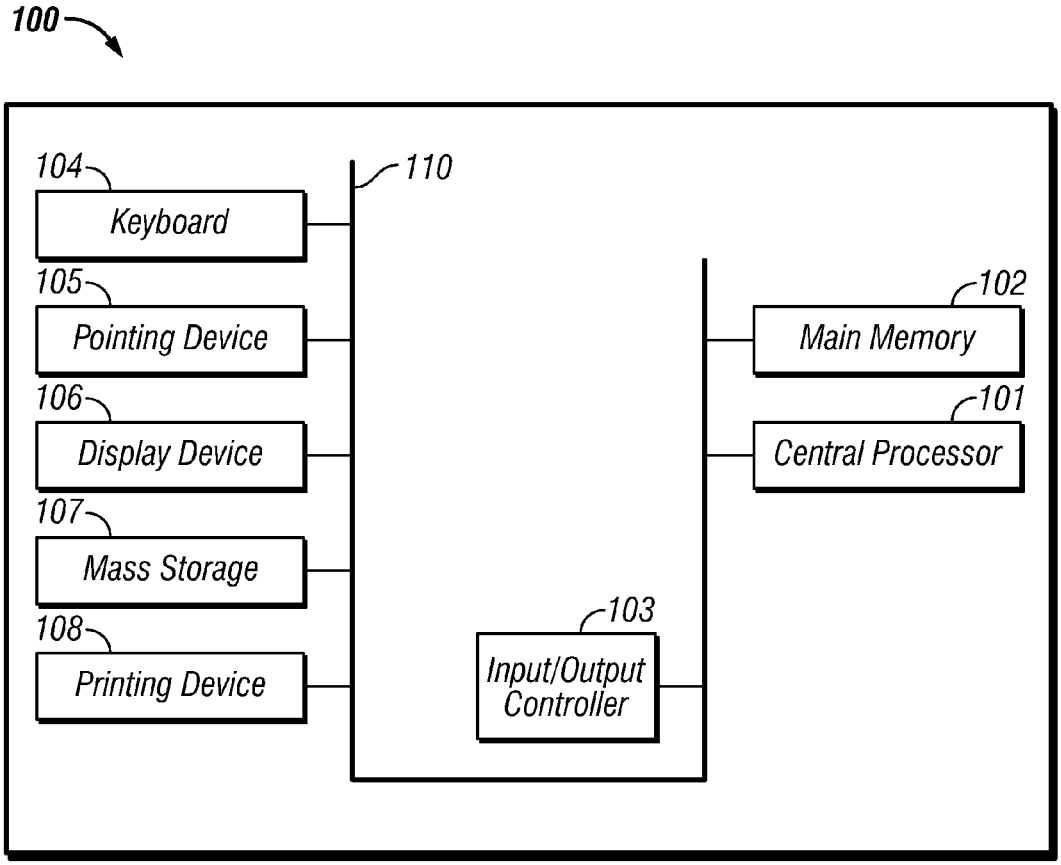
FIG. 1 illustrates a schematic view of a computer system in which the present invention may be embodied.
Figure 2:
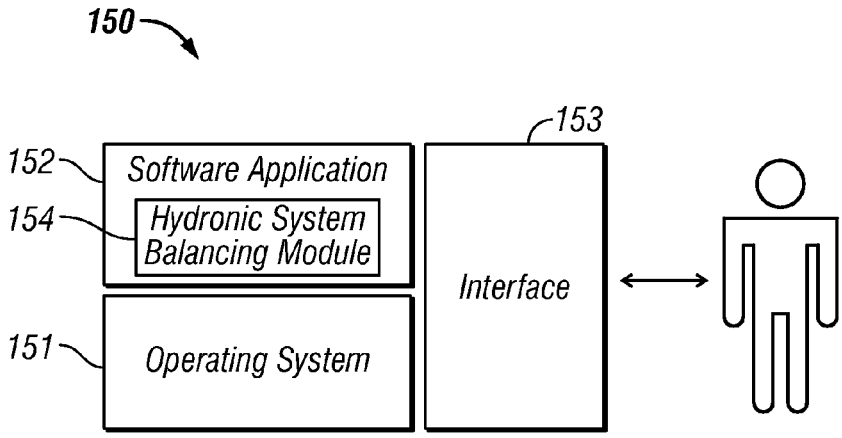
FIG. 2 illustrates a schematic view of a software system including an operating system, application software, and a user interface for carrying out the present invention.

FIGS. 1-2 are provided as exemplary diagrams of data processing environments in which embodiments of the present invention may be implemented. It should be appreciated that FIGS. 1-2 are only exemplary and are not intended to assert or imply any limitation with regard to the environments in which aspects or embodiments of the present invention may be implemented. Many modifications to the depicted environments may be made without departing from the spirit and scope of the present invention.

FIG. 1 illustrates that the present invention may be embodied in the context of a data-processing apparatus 100 comprising a central processor 101, a main memory 102, an input/output controller 103, a keyboard 104, a pointing device 105 (e.g., mouse, track ball, pen device, or the like), a display device 106, and a mass storage 107 (e.g., hard disk). Additional input/output devices, such as a printing device 108, may be included in the data-processing apparatus 100 as desired. As illustrated, the various components of the data-processing apparatus 100 communicate through a system bus 110 or similar architecture.

Figure 4:
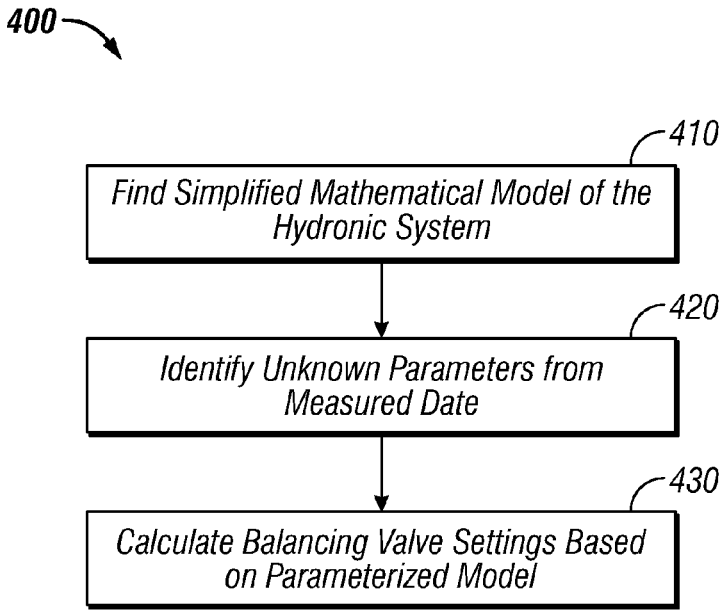
FIG. 4 illustrates a high level flow chart of operations illustrating logical operational steps of a method for model-based multivariable balancing for distributed hydronic networks, in accordance with a preferred embodiment.

FIG. 2 illustrates a computer software system 150 that can be provided for directing the operation of the data-processing apparatus 100. Software system 150, which can be stored in system memory 102 and on disk memory 107, generally includes a kernel or operating system 151 and a shell or interface 153. One or more application programs, such as application software 152, may be "loaded" (i.e., transferred from storage 107 into memory 102) for execution by the data-processing apparatus 100. The application software 152 also includes a hydronic system balancing software module 154 for model-based multivariable balancing for distributed hydronic networks, as illustrated in FIG. 4. The data-processing apparatus 100 receives user commands and data through user interface 153; these inputs may then be acted upon by the data-processing apparatus 100 in accordance with instructions from operating module 151 and/or application module 152.

The interface 153, which is preferably a graphical user interface (GUI), also serves to display results, whereupon the user may supply additional inputs or terminate the session. In an embodiment, operating system 151 and interface 153 can be implemented in the context of a "Windows" system. Application module 152, on the other hand, can include instructions, such as the various operations described herein with respect to the various components and modules described herein such as, for example, the method 400 depicted in FIG. 4.

The following description is presented with respect to embodiments of the present invention, which can be embodied in the context of a data-processing system such as data-processing apparatus 100, computer software system 150 depicted respectively in FIGS. 1-2. The present invention, however, is not limited to any particular application or any particular environment. Instead, those skilled in the art will find that the system and methods of the present invention may be advantageously applied to a variety of system and application software, including database management systems, word processors, and the like. Moreover, the present invention may be embodied on a variety of different platforms, including Macintosh, UNIX, LINUX, and the like. Therefore, the description of the exemplary embodiments, which follows, is for purposes of illustration and not considered a limitation.

Figure 3:
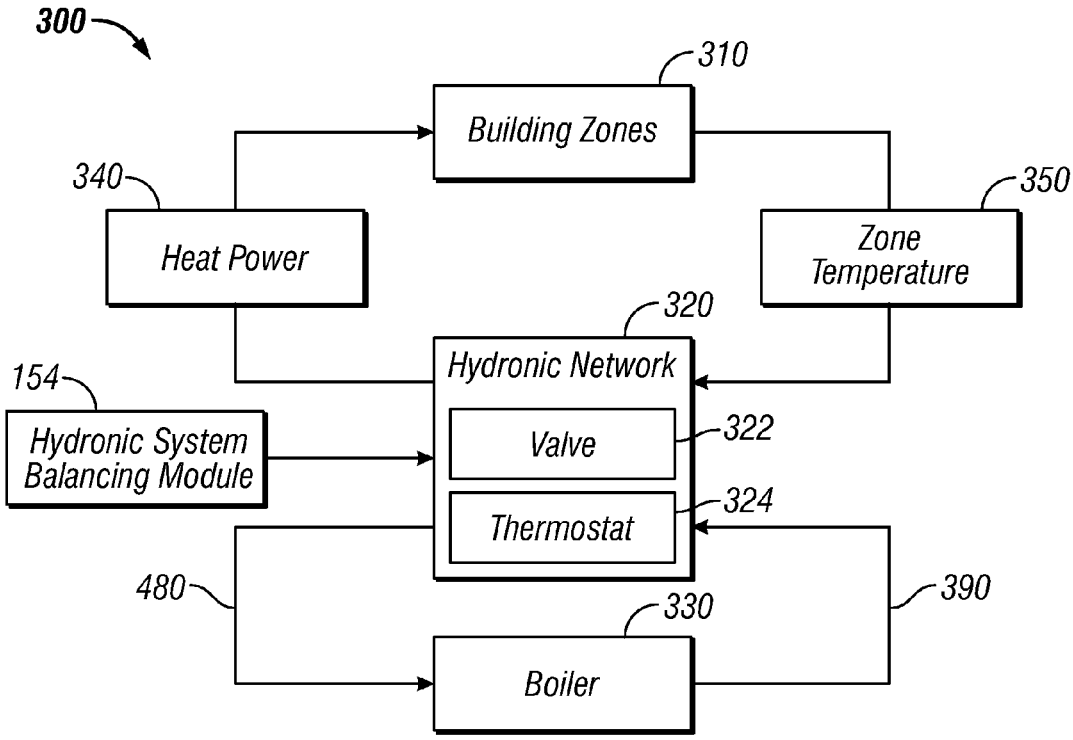
FIG. 3 illustrates an exemplary block diagram showing a hydronic heating and cooling system which can be implemented, in accordance with a preferred embodiment.

FIG. 3 illustrates an exemplary block diagram of a hydronic heating and cooling system 300 which can be implemented, in accordance with a preferred embodiment. Note that in FIGS. 1-7, identical or similar parts are generally indicated by identical reference numerals. The hydronic system 300 illustrates application of water heating system for a building. The hydronic system 300 generally includes a hydronic network 320 that forms a major part of the hydronic system 300, which can be adapted to be connected to building zones 310 of a residential or commercial installation for delivering hot or cool air thereto.

The hydronic network 320 can be configured to include a number of valve control circuits 322 and thermostat control circuits 324. Such a control system can be implemented in the context of most hydronic home heating system control circuits. Note that the embodiments discussed herein generally relate to a hydronic heating and cooling system. It can be appreciated, however, that such embodiments can be implemented in the context of other hydronic systems and designs. The discussion of a hydronic heating system, as utilized herein, is thus presented for general illustrative purposes only and is not considered a limiting feature of the disclosed embodiments.

The hydronic network 320 generally supplies heat power 340 from a boiler 330 to the building zones 310 based on a zone temperature 350. The boiler 330 pumps hot water a common riser 390 from which it flows through a multiplicity of branch lines, each including one or more terminals to the hydronic network 320. Then, the multiple streams are reunited in a common downpipe 480 that leads back to the boiler 330. The hydronic system balancing software module 154 can be utilized to balance the flow in the individual branches associated with the hydronic network 320 to achieve desired technical and economic performance based on non-iterative centralized approach. Thus each branch can be provided with a balancing valve such as valve 322, which is nothing more than a lockable flow-control valve that is adjusted until a predetermined flow, normally measured in gallons per minute, is obtained in the branch. The hydronic system balancing software module 154 provides model-based multivariable balancing distributed hydronic network 320 to achieve desired technical and economic performance of the system 300.

FIG. 4 illustrates a high level flow chart of operations illustrating logical operational steps of a method 400 for model-based multivariable balancing for distributed hydronic networks, in accordance with a preferred embodiment. Note that the method 400 can be implemented in the context of a computer-useable medium that contains a program product. The method 400 depicted in FIG. 4 can also be implemented in a computer-usable medium containing a program product. In some embodiments, method 400 can thus be provided in the form of computer software.

Programs defining functions on the present invention can be delivered to a data storage system or a computer system via a variety of signal-bearing media, which include, without limitation, non-writable storage media (e.g., CD-ROM), writable storage media (e.g., hard disk drive, read/write CD ROM, optical media), system memory such as, but not limited to, Random Access Memory (RAM), and communication media, such as computer and telephone networks including Ethernet, the Internet, wireless networks, and like network systems. It should be understood, therefore, that such signal-bearing media when carrying or encoding computer readable instructions that direct method functions in the present invention, represent alternative embodiments of the present invention. Further, it is understood that the present invention may be implemented by a system having means in the form of hardware, software, or a combination of software and hardware as described herein or their equivalent. Thus, the method 400 described herein can be deployed as process software in the context of a computer system or data-processing system as that depicted in FIGS. 1-2.

Figure 5:
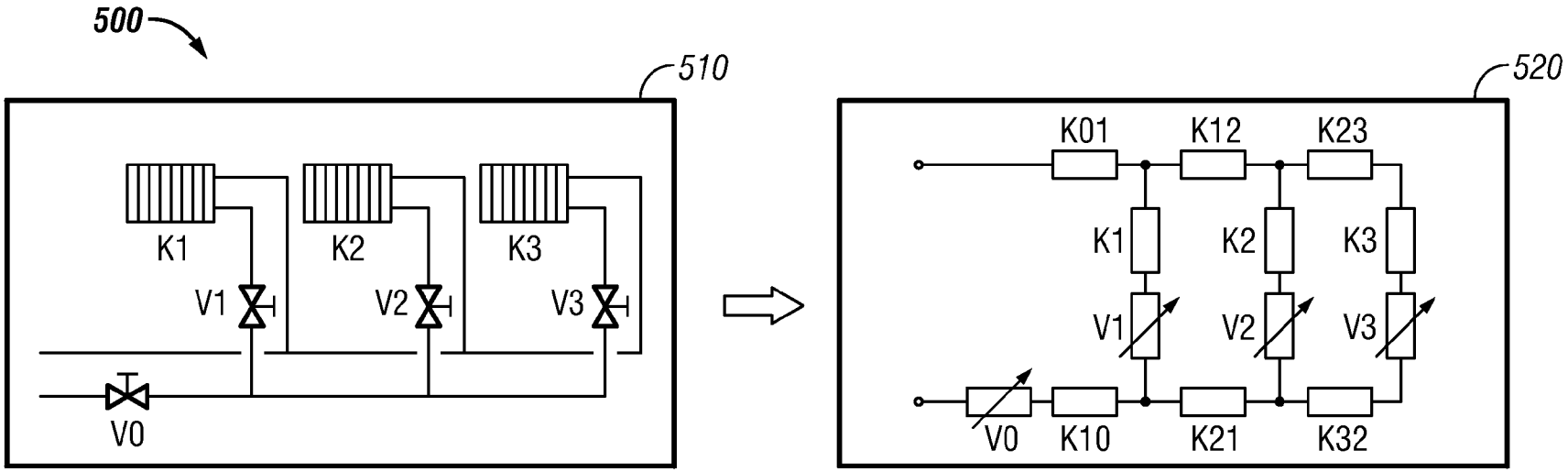
FIG. 5 illustrates a schematic diagram illustrating analogy between hydronic systems and electrical circuits, in accordance with a preferred embodiment.

A simplified mathematical model of the hydronic system 510 can be found, as depicted at block 410. FIG. 5 illustrates a schematic diagram 500 illustrating analogy between hydronic systems 510 and an equivalent circuit model 520, in accordance with a preferred embodiment. The simplified mathematical model of hydronic system 510 can provide a mathematical description of the hydronic system 510 utilizing an analogy between hydronic systems 510 and model 520.

The hydronic system 510 can be first converted into its equivalent circuit model, such as, for example, model 520. For example, the pressure drop [Pa] in the hydronic system 510 corresponds to voltage [V] in an electrical circuit(s) as represented by, for example, model 520. Similarly, liquid flow rate [kg/s] in the hydronic system 510 corresponds to current [A] associated with the electrical circuit 520. Thereafter, applying KCL (Kirchhoff's Current Law) and/or KVL (Kirchhoff's Voltage Law) in the circuit model 520, a set of equations can be obtained to form a simplified mathematical description of the hydronic system 510. By applying KVL in the equivalent circuit model 520, the mathematical model of the hydronic system 510 can be calculated as shown in equations (1), (2), and (3).

$$\text{LOOP1: } 0=\Delta P_B-\Delta P_{V0}-|K_{01}+K_{10})(Q_1+Q_2+Q_3)^2-K_1Q_1^2-\Delta P_{V1} \tag{1}$$

$$\text{LOOP2: } 0=66\ P_B-\Delta P_{V0}-|K_{01}+K_{10})(Q_1+Q_2+Q_3)^2-\{K_{12}+K_{21})(Q_2+Q_3\}^2-K_2Q_2^2-\Delta P_{V2} \tag{2}$$

$$\text{LOOP3: } 0=\Delta P_B-\Delta P_{V0}-|K_{01}+K_{10})(Q_1+Q_2+Q_3)^2-\{K_{12}+K_{21})(Q_2+Q_3\}^2-(K_3+K_{23}K_{32})Q_3^2-\Delta P_{V3} \tag{3}$$

The set of equations (1), (2), and (3) of the mathematical model can be written into a suitable matrix form as illustrated below in equation (4).

$$\begin{bmatrix} 1 & -1 & -1 & 0 & 0 \\ 1 & -1 & 0 & -1 & 0 \\ 1 & -1 & 0 & 0 & -1 \end{bmatrix} \tag{4}$$

-continued $$\begin{bmatrix} \Delta P_B \\ \Delta P_{V0} \\ \Delta P_{V1} \\ \Delta P_{V2} \\ \Delta P_{V3} \end{bmatrix} = \begin{bmatrix} (Q_1+Q_2+Q_3)^2 & Q_1^2 & 0 & 0 & 0 \\ (Q_1+Q_2+Q_3)^2 & 0 & (Q_2+Q_3)^2 & Q_2^2 & 0 \\ (Q_1+Q_2+Q_3)^2 & 0 & (Q_2+Q_3)^2 & 0 & Q_3^2 \end{bmatrix} \begin{bmatrix} K_{01}+K_{10} \\ K_1 \\ K_{12}+K_{21} \\ K_2 \\ K_{23}+K_3+K_{32} \end{bmatrix}$$

The obtained matrix can be written as shown in equation (5)

$$\overline{M}\cdot\overline{\Delta p}=A\cdot k \tag{5}$$

wherein M, A, Δp are known and the vector k can be estimated utilizing a least square algorithm or another suitable method. It can be appreciated, of course, that a "least square algorithm" represents only possible example of such methods and that other approaches can be utilized in place of a least square algorithm. Thereafter, unknown parameters such as hydraulic resistances and pump parameters can be identified from measured data, as depicted at block 420. The simplified mathematical model 520 can be parameterized by a number of lumped parameters that depend on hydraulic resistances such as pipe segments, fittings, terminal units, etc. The values of such parameters can be typically regarded as unknown, because it is not feasible to utilize the theoretical values from the project design. The set of lumped parameters can be identified utilizing a suitable model structure and a set of available measurements such as, for example, the mathematical model 520 depicted in FIG. 5. The set of lumped parameters can be considered as a minimal set of parameters from the point of following optimization problem point of view.

FIG. 6 illustrates an exemplary table of available measurements associated with a hydronic system, in accordance with a preferred embodiment. Next, as depicted at block 430, balancing valves settings can be calculated based on parameterized model. The balancing valves settings can be calculated utilizing the mathematical model obtained previously and the pressure drops can be estimated. The mathematical model as shown in equation (5) can be rewritten to a suitable matrix form as illustrated below in equation (6).

$$\begin{bmatrix} 1 & -1 & -1 & 0 & 0 \\ 1 & -1 & 0 & -1 & 0 \\ 1 & -1 & 0 & 0 & -1 \end{bmatrix} \tag{6}$$

$$\begin{bmatrix} \Delta P_B \\ \Delta P_{V0} \\ \Delta P_{V1} \\ \Delta P_{V2} \\ \Delta P_{V3} \end{bmatrix} = \begin{bmatrix} K_1 & 0 & 0 & 0 & K_{01}+K_{10} \\ 0 & K_2 & 0 & K_{12}+K_{21} & K_{01}+K_{10} \\ 0 & 0 & K_3+K_{23}+K_{32} & K_{12}+K_{21} & K_{01}+K_{10} \end{bmatrix}$$

-continued $$\left(\begin{bmatrix} 1 & 0 & 0 \\ 0 & 1 & 0 \\ 0 & 0 & 1 \\ 0 & 1 & 1 \\ 1 & 1 & 1 \end{bmatrix}\begin{bmatrix} Q_1 \\ Q_2 \\ Q_3 \end{bmatrix}\right)^2$$

The obtained equation (6) can be written as shown in equation (7).

$$\Delta P_{pump}1+M\cdot\Delta p=G(N\cdot q)^2 \tag{7}$$

In equation (7) above, it is assumed that the pumping pressure (i.e., pump head) is known. It can be appreciated that the approach described herein is not limited by this because the pump head characteristic can be estimated by modifying relevant equations.

The pressure drop vector can be estimated utilizing known vectors and matrices. Hence, the design of the hydronic network can be calculated, as shown in equations (6) and (7).

$$x_{design}=G(N\cdot q_{design})^2-1\Delta P_{pump} \tag{6}$$

$$M\cdot\Delta p=x_{design} \tag{7}$$

The set of equations (6) and (7) have greater number of variables than the number of equations and therefore the solution is not unique and there is a space for optimization. The optimization task minimize the pressure drops over selected balancing valves with respect to given minimum and maximum values, mathematically as show in equation (8)

$$\Delta p_{design} = \underset{\Delta p}{\operatorname{argmin}}(b^T\cdot\Delta p) \tag{8}$$

$$\text{s.t. } R\cdot\Delta p \le r,\ M\cdot\Delta p = x_{design}$$

wherein the i-th element of vector b can be as shown in equations (9), (10) and (11)

$$b_i>0 \tag{9}$$

wherein the i-th pressure drop of vector Δp can be minimized $$b_i<0 \tag{10}$$

wherein the i-th pressure drop of vector Δp can be maximized $$b_i=0 \tag{11}$$

wherein the i-th pressure drop of vector Δp can be selected so that the constraints of the problem cannot be violated.

Figure 7:
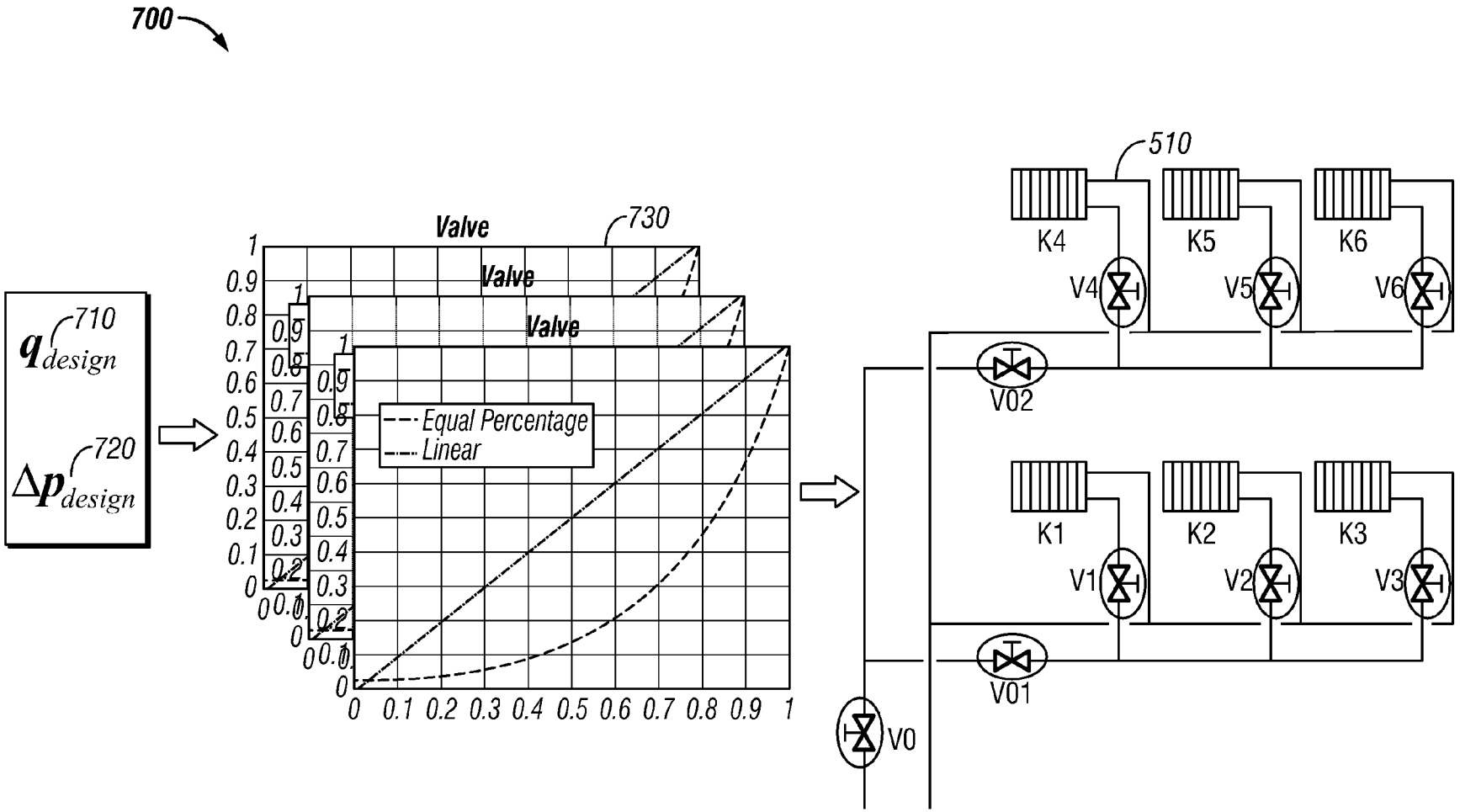
FIG. 7 illustrates a schematic diagram illustrating multivariable balancing of hydronic networks, in accordance with a preferred embodiment.

Additional constraints to the optimization problem (for example that the pressure drop across balancing valves must be greater than specified minimum value) can also be included and the resulting optimization problem can be solved by standard algorithms of mathematical programming. Finally, the design flow 710 and corresponding pressure drops 720 for all balancing valves can be calculated and the valve settings can be found utilizing the valve characteristics 730 to obtain a balanced hydronic system 510, as shown in FIG. 7. The model-based multivariable-balancing algorithm is based on simplified mathematical model where all parameters are considered to be known either from the project design or from the identification procedure. The output from the procedure is optimal pressure drop and/or setting of all balancing valves.

The multivariable-balancing algorithm can be formulated as an optimization problem where the subject of optimization is to minimize the sum of pressure drops across selected balancing valves. The method follows a systematic approach and gives accurate description of the hydronic system. Such an approach can be implemented as a computer program with possible interface to hydronic network actuators and sensors which can support application engineers in the field to reduce the effort and time needed for hydronic heating balancing.

Formulation as an optimization problem enables computation of the optimal settings of the hydronic network and thus improved economic performances with respect to the system can be attained, for example, by advising to decrease the pump speed, which in turn can save supply energy.

While the present invention has been particularly shown and described with reference to a preferred embodiment, it will be understood by those skilled in the art that various changes in form and detail may be made therein without departing from the spirit and scope of the invention. Furthermore, as used in the specification and the appended claims, the term "computer" or "system" or "computer system" or "computing device" includes any data processing system including, but not limited to, personal computers, servers, workstations, network computers, main frame computers, routers, switches, Personal Digital Assistants (PDA's), telephones, and any other system capable of processing, transmitting, receiving, capturing and/or storing data.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for optimal model-based multivariable balancing for distributed hydronic networks, comprising:

determining a simplified mathematical model for a distributed hydronic system, wherein said simplified mathematical model is parameterized utilizing a plurality of lumped parameters that depends on a plurality of hydraulic resistances and pumped parameters, wherein said model-based multivariable balancing algorithm is based on a non-iterative approach;

identifying said plurality of lumped parameters utilizing a plurality of available measurements and said simplified mathematical model in order to form a parameterized model; and calculating a plurality of balancing valve settings by reformulating said simplified mathematical model based on said parameterized model and by solving a mathematical optimization problem utilizing global differential information, wherein said mathematical optimization problem minimizes a sum of pressure drop across a plurality of selected balancing valves.

2. The method of claim 1 wherein said global differential information comprises pressure data.

3. The method of claim 1 wherein said global differential information comprises flow rate data.

4. The method of claim 1 wherein determining said simplified mathematical model for said distributed hydronic system, further comprises:

converting said distributed hydronic system into an equivalent circuit model; and applying KCL with respect to said equivalent circuit model to obtain a particular set of equations.

5. The method of claim 1 wherein determining said simplified mathematical model for said distributed hydronic system, further comprises:

converting said distributed hydronic system into an equivalent circuit; and applying KVL with respect to said equivalent circuit model to obtain a particular set of equations.

6. The method of claim 1 further comprising: providing a centralized solution by storing a plurality of measured variables in a central unit.

7. A computer-implemented system for optimal model-based multivariable balancing for distributed hydronic networks comprising:

a processor;

a data bus coupled to said processor; and a non-transitory computer-usable medium embodying computer code, said non-transitory computer-usable medium being coupled to said data bus, said computer program code comprising instructions executable by said processor and configured for:

determining a simplified mathematical model for a distributed hydronic system, wherein said simplified mathematical model is parameterized utilizing a plurality of lumped parameters that depends on a plurality of hydraulic resistances and pumped parameters, wherein said model-based multivariable balancing algorithm is based on a non-iterative approach;

identifying said plurality of lumped parameters utilizing a plurality of available measurements and said simplified mathematical model in order to form a parameterized model; and calculating a plurality of balancing valve settings by reformulating said simplified mathematical model based on said parameterized model and by solving a mathematical optimization problem utilizing global differential information, wherein said mathematical optimization problem minimizes a sum of pressure drop across a plurality of selected balancing valves.

8. The system of claim 7 wherein said global differential information comprises pressure data.

9. The system of claim 7 wherein said global differential information comprises flow rate data.

10. The system of claim 7 wherein determining said simplified mathematical model for said distributed hydronic system, further comprises:

converting said distributed hydronic system into an equivalent circuit model; and applying KCL with respect to said equivalent circuit model to obtain a particular set of equations.

11. The system of claim 7 wherein determining said simplified mathematical model for said distributed hydronic system, further comprises:

converting said distributed hydronic system into an equivalent circuit; and applying KVL with respect to said equivalent circuit model to obtain a particular set of equations.

12. A non-transitory computer-usable medium for optimal model-based multivariable balancing for distributed hydronic networks, said non-transitory computer-usable medium embodying computer program code, wherein said computer-implemented medium is coupled to a data bus, wherein said computer program code comprises computer executable instructions executable by a processor and configured for:

determining a simplified mathematical model for a distributed hydronic system, wherein said simplified mathematical model is parameterized utilizing a plurality of lumped parameters that depends on a plurality of hydraulic resistances and pumped parameters, wherein said model-based multivariable balancing algorithm is based on a non-iterative approach;

identifying said plurality of lumped parameters utilizing a plurality of available measurements and said simplified mathematical model in order to form a parameterized model; and calculating a plurality of balancing valve settings by reformulating said simplified mathematical model based on said parameterized model and by solving a mathematical optimization problem utilizing global differential information.

13. The non-transitory computer-usable medium of claim 12 wherein said global differential information comprises at least one of the following types of data: pressure data and flow rate data.

14. The non-transitory computer-usable medium of claim 12 wherein said embodied computer program code further comprises computer executable instructions configured for:

converting said distributed hydronic system into an equivalent circuit model; and applying KCL with respect to said equivalent circuit model to obtain a particular set of equations.

15. The non-transitory computer-usable medium of claim 12 wherein said embodied computer program code further comprises computer executable instructions configured for:

converting said distributed hydronic system into an equivalent circuit; and applying KVL with respect to said equivalent circuit model to obtain a particular set of equations.

* * * * *